US008398068B2

(12) United States Patent
Asada et al.

(10) Patent No.: US 8,398,068 B2
(45) Date of Patent: Mar. 19, 2013

(54) IMAGE RECORDING DEVICE

(75) Inventors: Tetsuo Asada, Kuwana (JP); Satoru Nakakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 79 days.

(21) Appl. No.: 12/894,030

(22) Filed: Sep. 29, 2010

(65) Prior Publication Data

US 2011/0241288 A1 Oct. 6, 2011

(30) Foreign Application Priority Data

Mar. 30, 2010 (JP) ..... 2010-076846

(51) Int. Cl.
*B65H 5/26* (2006.01)
*B65H 3/44* (2006.01)

(52) U.S. Cl. ..... 271/9.08; 271/9.07; 271/9.11; 271/162; 271/164

(58) Field of Classification Search ..... 271/9.11, 271/9.09, 9.08, 9.13, 9.07, 162, 164
See application file for complete search history.

(56) References Cited

U.S. PATENT DOCUMENTS 3,989,236 A * 11/1976 Komori et al. ..... 271/4.1
4,131,274 A * 12/1978 Sue ..... 271/9.11
7,403,739 B2 * 7/2008 Hwang ..... 399/391
7,547,011 B2 6/2009 Kurata et al.
7,584,950 B2 9/2009 Asada et al.
7,600,745 B2 * 10/2009 Asada ..... 271/9.08
7,628,392 B2 12/2009 Shiohara et al.
7,654,515 B2 2/2010 Koga (Continued)

FOREIGN PATENT DOCUMENTS

JP H06-008138 Y2 3/1994
JP 2007-230777 A 9/2007

(Continued)

OTHER PUBLICATIONS

United States Patent and Trademark Office, Office Action for U.S. Appl. No. 13/242,395 (co-pending U.S. patent application), mailed Sep. 11, 2012.

*Primary Examiner* — Luis A Gonzalez
(74) *Attorney, Agent, or Firm* — Baker Botts L.L.P.

(57) ABSTRACT

An image recording device includes a tray unit, a sheet feeder disposed above the tray unit, a recording unit disposed above the sheet feeder, and a unit for discharging the sheet having an image recorded thereon. The tray unit includes a first tray for holding thereon a first sheet, a second tray disposed above the first tray to hold thereon a second sheet, and a third tray disposed above the first tray. The second tray selectively moves between a first position and a second position. When the second tray is in the first position, the sheet feeder feeds the second sheet from the second tray, and the third tray receives the second sheet discharged from the discharging unit. When the second tray is in the second position, the sheet feeder feeds the first sheet from the first tray, and the first tray, the second tray, and the third tray overlap one another vertically.

18 Claims, 6 Drawing Sheets

U.S. PATENT DOCUMENTS

| | | | | |
|---|---|---|---|---|
| 7,677,548 | B2 | 3/2010 | Chino | |
| 7,681,875 | B2 | 3/2010 | Asada et al. | |
| 7,690,640 | B2 | 4/2010 | Koga et al. | |
| 7,748,692 | B2 | 7/2010 | Shiohara | |
| 7,878,500 | B2 | 2/2011 | Wakakusa | |
| 2007/0075476 | A1 * | 4/2007 | Shiohara | 271/9.01 |
| 2007/0182803 | A1 | 8/2007 | Asada et al. | |
| 2010/0164169 | A1 | 7/2010 | Wakakusa | |
| 2012/0080833 | A1 | 4/2012 | Asada et al. | |
| 2012/0081488 | A1 | 4/2012 | Asada et al. | |
| 2012/0081489 | A1 | 4/2012 | Asada et al. | |

FOREIGN PATENT DOCUMENTS

| | | | |
|---|---|---|---|
| JP | 2010-037095 | A | 2/2010 |

* cited by examiner

IMAGE RECORDING DEVICE

CROSS REFERENCE TO RELATED APPLICATION

This application claims priority from Japanese Patent Application No. 2010-076846, which was filed on Mar. 30, 2010, the disclosure of which is incorporated herein by reference in its entirety.

BACKGROUND OF THE INVENTION

1. Field of the Invention

This application relates to an image recording device comprising a tray unit that includes a plurality of trays and is configured to hold recoding mediums, e.g., sheets, and to receive sheets discharged after an image is recorded thereon.

2. Description of Related Art

A known image recording device comprises a housing, a tray unit configured to hold sheets thereon and to move relative to a lower portion of the housing, a recording unit disposed in an upper portion of the housing, and a discharging unit configured to discharge the sheet after the recording unit records an image on the sheet. The image recording device further comprises a sheet feeder disposed between the recording unit and the tray unit and configured to feed the sheet from the tray unit to the recording unit via a conveying path.

In the known image recording device, the tray unit comprises a main tray and a second tray disposed on the main tray, and the second tray is configured to slide on the main tray between a first position and a second position. When the second tray is in the second position, the sheet feeder feeds a first sheet from the main tray, and the second tray receives the first sheet discharged by the discharging unit. When the second sheet is in the first position, the sheet feeder feeds a second sheet from the second tray, and the second tray receives the second tray discharged by the discharging unit.

When a return guide for double-sided recording is additionally provided in the housing such that a sheet having an image recorded on one side thereof is returned to the recording unit via the conveying path, or when an extra mechanism or board is provided around the recording unit to perform a particular function, the height of the housing may increase, and thus the discharging unit may be relocated at an upper position farther from the second tray. If the distance between the discharging unit and a sheet receiving surface of the second tray increases, a discharged sheet may hang from the discharging unit or a leading edge of the discharged sheet may be bent or folded before reaching the sheet receiving surface of the second tray, resulting in a sheet discharging failure.

SUMMARY OF THE INVENTION

Therefore, a need has arisen for an image recording device that overcomes these and other shortcomings of the related art and is configured to discharge recorded sheets properly on a tray unit while the image recording device remains compact.

According to an embodiment of the invention, an image recording device comprises a tray unit configured to hold thereon a first sheet and a second sheet, a sheet feeder disposed above the tray unit and configured to selectively feed the first sheet and the second sheet from the tray unit in a first direction, a recording unit disposed above the sheet feeder and configured to record an image on the sheet fed by the sheet feeder, and a discharging unit configured to discharge the sheet after the recording unit records the image on the sheet. The tray unit comprises a first tray comprising a first holding surface for holding thereon the first sheet, a second tray disposed above the first tray and comprising a second holding surface for holding thereon the second sheet, and a third tray disposed above the first tray. The second tray is configured to selectively move between a first position and a second position which is upstream in the first direction from the first position. When the second tray is in the first position, the sheet feeder is configured to feed the second sheet from the second tray, and the third tray is configured to receive the second sheet discharged from the discharging unit. When the second tray is in the second position, the sheet feeder is configured to feed the first sheet from the first tray, and the first tray, the second tray, and the third tray overlap one another vertically.

According to another embodiment of the invention, an image recording device comprises a tray unit that comprises a first tray comprising a first holding surface for holding thereon a first sheet, and a second tray disposed above the first tray and comprising a second holding surface for holding thereon a second sheet. The image recording device further comprises a sheet feeder disposed above the tray unit and configured to selectively feed the first sheet and the second sheet from the tray unit in a first direction, a recording unit disposed above the sheet feeder and configured to record an image on the sheet fed by the sheet feeder, a discharging unit configured to discharge the sheet after the recording unit records the image on the sheet, a linking unit configured to link the first tray to the second tray and to pivot about a pivot axis extending in a second direction perpendicular to the first direction and parallel to the first holding surface of the first tray, and a stopper configured to stop the linking unit from pivoting beyond a second pivot position in a direction away from a first pivot position. When the linking unit is in the first pivot position, the second tray is located in a first position, and the sheet feeder is configured to feed the second sheet from the second tray. When the linking unit is stopped by the stopper in the second pivot position, the second tray is located in a second position which is higher than the first position and upstream from the first position in the first direction, and the second tray is configured to receive the first sheet discharged from the discharging unit.

Other objects, features, and advantages will be apparent to persons of ordinary skill in the art from the following detailed description of the invention and the accompanying drawings.

BRIEF DESCRIPTION OF THE DRAWINGS

For a more complete understanding of the invention, the needs satisfied thereby, and the features and technical advantages thereof, reference now is made to the following descriptions taken in connection with the accompanying drawings.

DETAILED DESCRIPTION OF EMBODIMENTS

Embodiments of the invention and their features and technical advantages may be understood by referring to FIGS. 1-6, like numerals being used for like corresponding parts in the various drawings.

Figure 1:
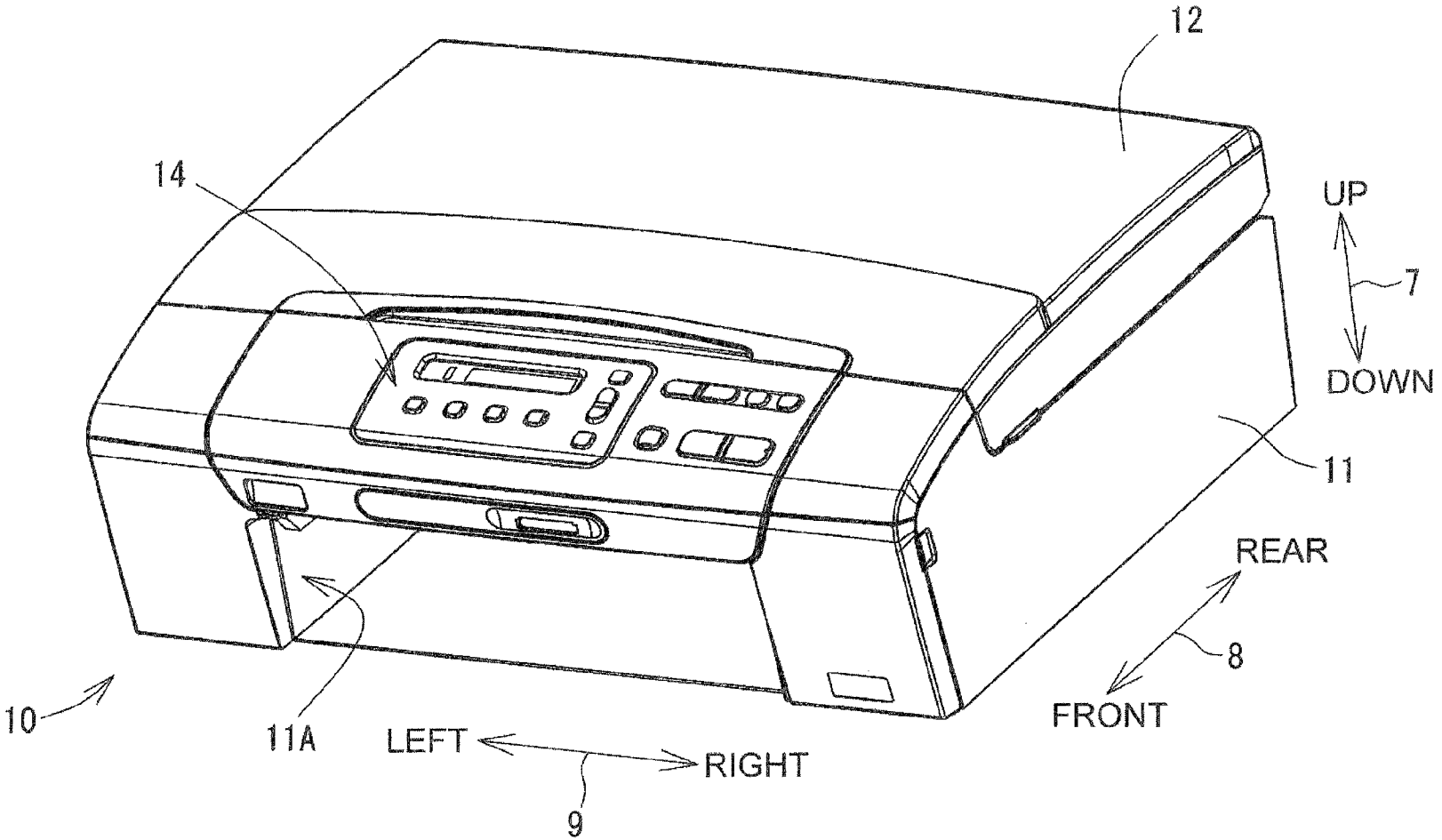
FIG. 1 is a perspective view of an image recording device, e.g., a multi-function device, according to an embodiment of the invention.

A preferred embodiment of the present invention will be described below with reference to the drawings. A multi-function device 10 of FIG. 1 having the scan function, the print function, the copy function, and the facsimile function will be described below as an image recording device of the present invention. However, the image recording device is not limited to the multi-function device 10, and may be another image recording device, such as a printer. In FIG. 1, a tray unit 13 is omitted.

The multi-function device 10 has a rectangular parallelepiped external shape, as shown in FIG. 1. Hereinafter, description will be made while a height direction, a depth direction, and a width direction of the multi-function device 10 are defined as an up-down direction 7, a right-left direction 8, and a front-rear direction 9, respectively.

Figure 2:
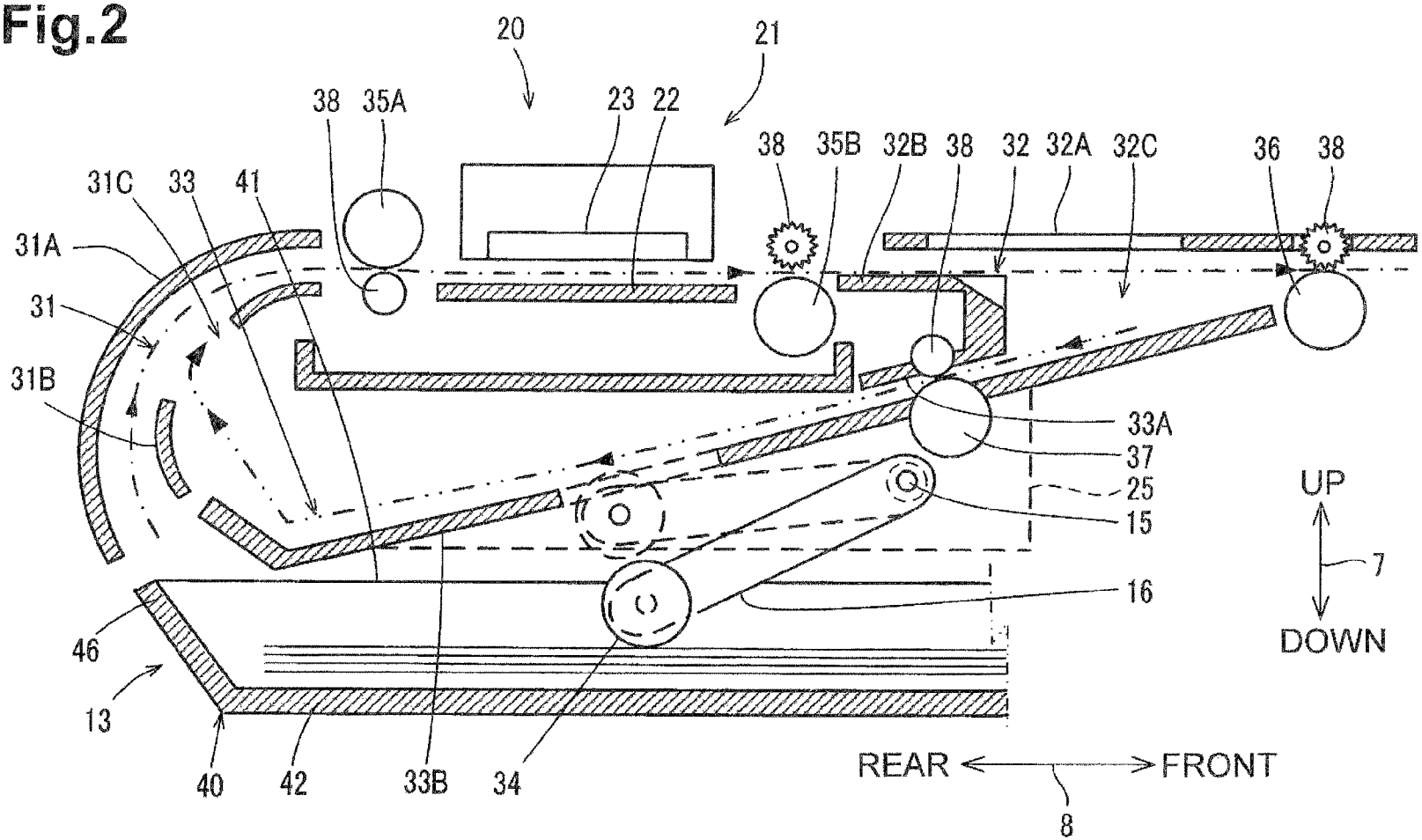
FIG. 2 is a schematic vertical cross-sectional view of a printer of the image recording apparatus of FIG. 1.

The multi-function device 10 includes a main body 11 and a top plate 12, which define the external shape thereof, and the tray unit 13 shown in FIG. 2. The main body 11 stores a scanner (not shown) for capturing an image, a printer 20 shown in FIG. 2 for recording an image on a recording medium, e.g., a sheet, feed rollers 34 for feeding sheets placed on the tray unit 13 to the printer 20, and a control board (not shown) including a controller for controlling the operations of the scanner, the printer 20, and the feed rollers 34. An operation panel 14 for receiving an input by a user is disposed at a front end portion of an upper part of the main body 11.

The top plate 12 is placed on the upper surface of the main body 11 and attached to the main body 11 with a hinge member (not shown). The user opens and closes the top plate 12 to thereby set between the top plate 12 and the main body 11 a document having an image desired to be captured. The image of the set document is scanned by the scanner and captured as image data. The scanner employs a well-known configuration, and detailed description thereof will be omitted. Detailed description will be made of the main body 11, the printer 20, the feed rollers 34, and the tray unit 13.

Figure 3:
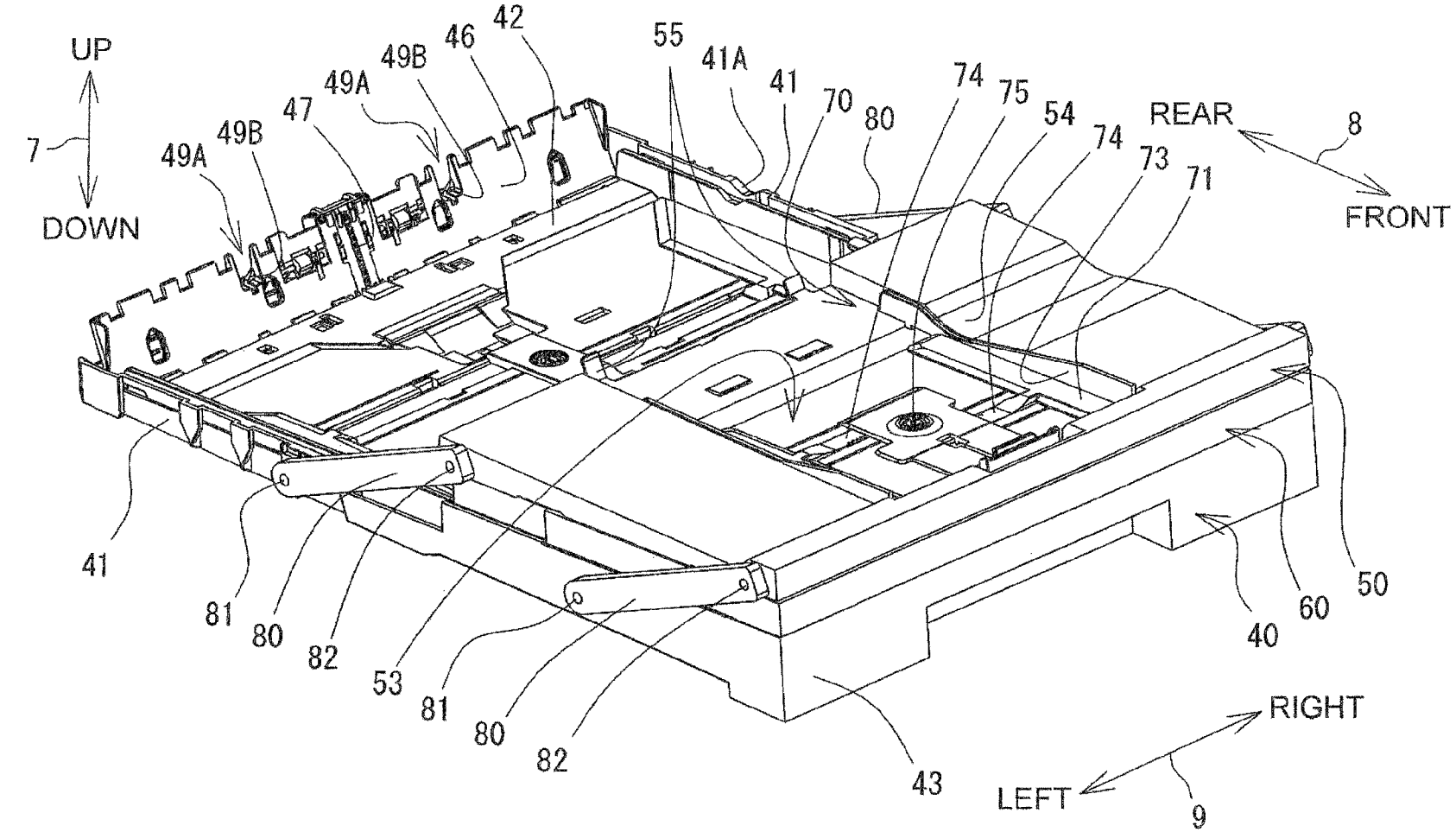
FIG. 3 is a perspective view of a tray unit of the printer when a second tray is in a second position.
Figure 4:
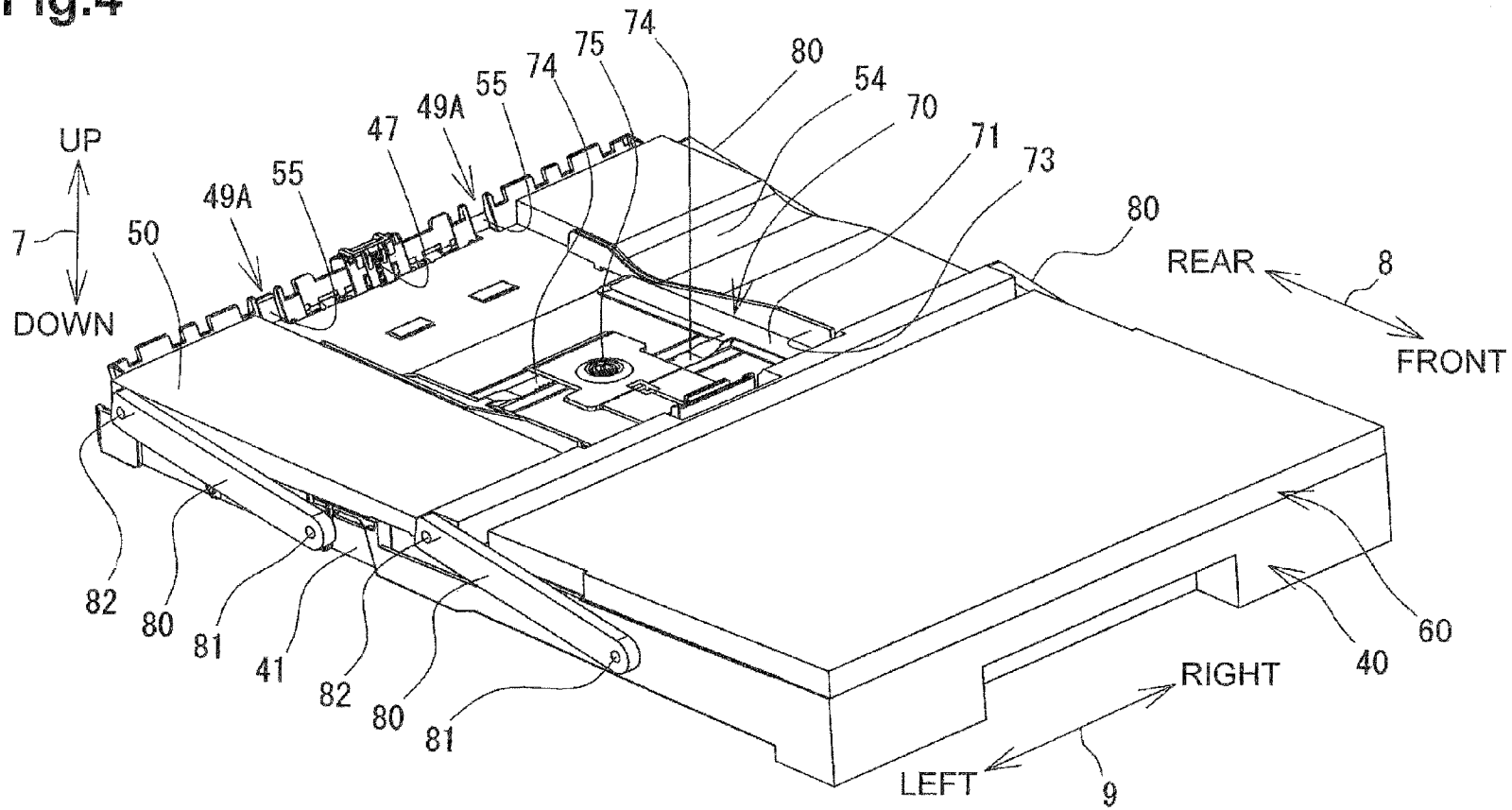
FIG. 4 is a perspective view of the tray unit when the second tray is in a first position.

The main body 11 has a recess 11A at a lower part thereof, and the recess 11A is open frontward. The tray unit 13 shown in FIG. 3 is stored in the recess 11A. The main body 11 supports the tray unit 13 to be slidable in the front-rear direction 8 on, for example, guide rails (not shown) provided to peripheral walls of the recess 11A. The tray unit 13 may be configured to be completely detachable from the main body 11, or may be configured to be supported by the main body 11 slidably in the front-rear direction.

As shown in FIG. 2, the printer 20 includes a recording unit 21 for recording an image on a sheet, a feed path 31 for conveying the sheet from the tray unit 13 to the recording unit 21, a discharge path 32 for discharging the sheet from the recording unit 21, and a return path 33 for double-sided printing. A convey roller 35A is provided in the feed path 31. A convey roller 35B and a discharge roller 36 is provided in the discharge path 32. A convey roller 37 is provided in the return path 33. The convey rollers 35A, 35B, and 37, the discharge roller 36, and the feed rollers 34 are driven to rotate by a drive unit (not shown) of the recording unit 21. The drive unit includes, for example, a drive motor controlled by the above-described controller and a drive transmission unit having gears and cams. Each of the drive motor and the drive transmission unit employs a well-known configuration, and detailed description thereof will be omitted.

As shown in FIG. 2, the recording unit 21 includes a plate-like platen 22 placed above a rear portion of the tray unit 13, a recording head 23 placed above the platen 22 to record an image on a sheet, the above-described drive unit, and a housing 25 for holding the platen 22 and guide rails (not shown) for guiding the recording head 23. The recording head 23 is supported by the guide rails to be slidable in the right-left direction 9. With the movement of the recording head 23 in the right-left direction 9 and the conveyance of the sheet in the front-rear direction 8, an image is recorded on upper surface of the sheet. The above-described configuration is an example of the recording unit 21. Thus, a recording unit employing another well-known configuration may be used.

As shown in FIG. 2, a pinch roller 38 is provided for each of the convey rollers 35A, 35B, and 37 and the discharge roller 36. The sheet is nipped by the convey rollers 35A, 35B, and 37 and the respective pinch rollers 38 and conveyed in accordance with the rotation of the convey rollers 35A, 35B, and 37 rotated by the above-described drive unit. Further, the sheet is discharged from between the discharge roller 36 and the corresponding pinch roller 38 onto the tray unit 13.

As shown in FIG. 2, the feed path 31 has an arc-shaped cross section, and extends between the tray unit 13 and the platen 22. The feed path 31 is defined by an outer support member 31A and an inner support member 31B each having an arc-shaped cross section and facing each other in the radial direction thereof. The support members 31A and 31B are made of, for example, a synthetic resin, and attached to the housing 25 of the recording unit 21 or the main body 11. The inner support member 31B has a communicating port 31C communicating with the return path 33.

The discharge path 32 extends frontward from the front end of the platen 22. The discharge path 32 is defined by an upper support member 32A and a lower support member 32B facing each other in the up-down direction 7. The lower support member 32B is provided between the convey roller 35B and the discharge roller 36 in the front-rear direction 8 to be separate from the discharge roller 36. A communicating port 32C communicating with the return path 33 is formed between the lower support member 32B and the discharge roller 36.

The return path 33 has one end communicating with the communicating port 31C in the feed path 31 and the other end communicating with the communicating port 32C in the discharge path 32, and extends under the platen 22. The return path 33 is defined by mutually facing support members 33A and 33B. The sheet recorded with an image by the recording unit 21 enters the discharge path 32, and thereafter the moving direction thereof is reversed in accordance with the reverse rotation of the discharge roller 36. Then, the sheet enters the return path 33 through the communicating port 32C. The sheet is then returned to the feed path 31 from the return path 33, and is conveyed from the feed path 31 to the platen 22 with the front and back sides thereof reversed. The back side of the sheet conveyed to the platen 22 is recorded with an image by the recording unit 21. The sheet recorded with images on both sides thereof is discharged from between the discharge roller 36 and the corresponding pinch roller 38, which function as the discharge unit.

Figure 6:
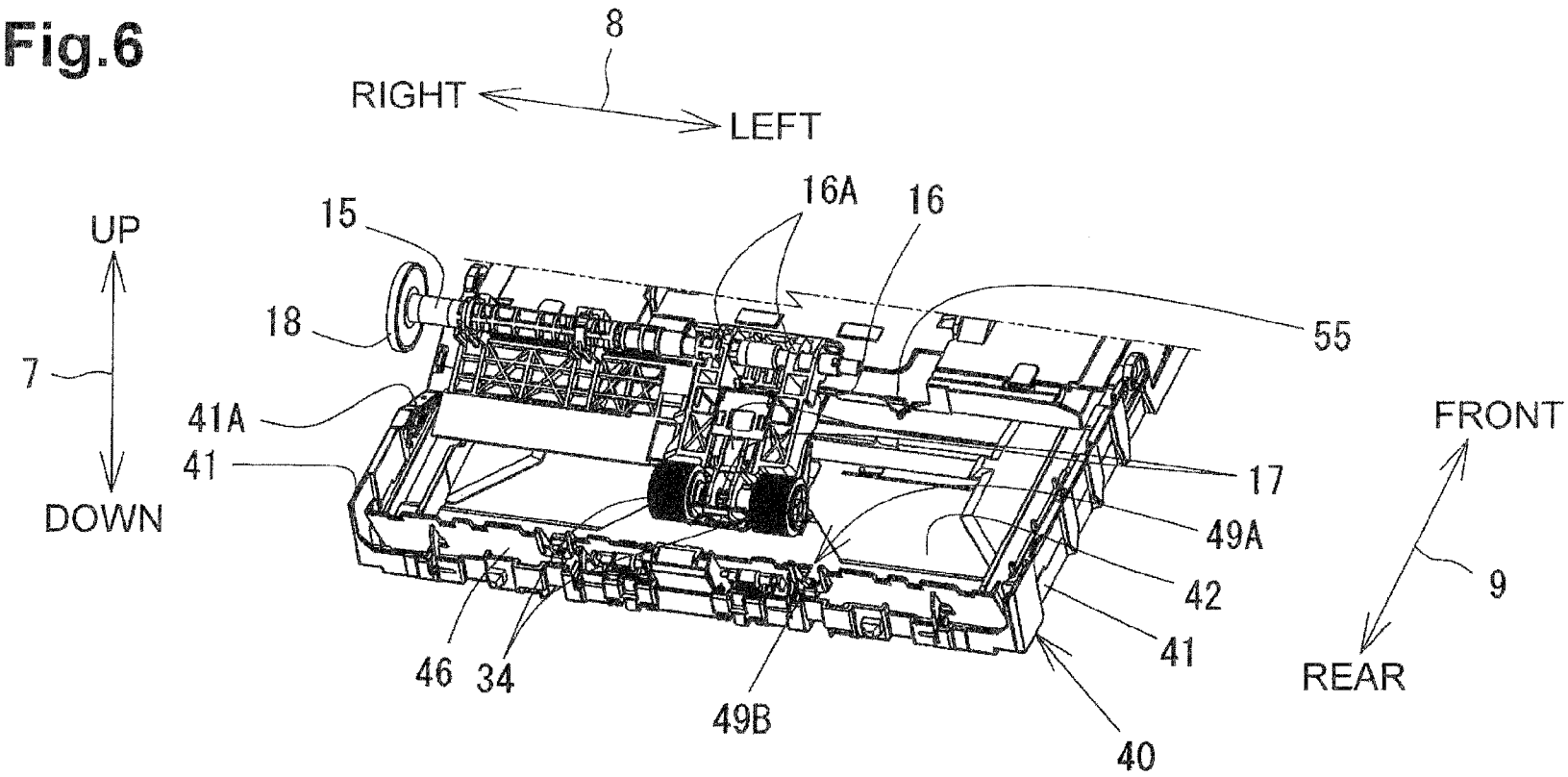
FIG. 6 is a perspective view of a feed arm and feed rollers of the printer.

The feed rollers 34 are supported by a shaft 15 and an arm 16 shown in FIGS. 2 and 6. The shaft 15 is pivotably supported by the main body 11 or the housing 25 of the recording unit 21. An end of the shaft 15 is coupled to a gear 18 rotated by the above-described drive unit. That is, the shaft 15 is rotated by the drive unit.

The arm 16 has one end portion having ring-like bearings 16A, through which the shaft 15 is inserted, and the other end portion having the pair of right-left feed rollers 34 rotatably attached thereto. That is, the arm 16 is pivotably supported by the shaft 15 while rotatably supporting the feed rollers 34. The arm 16 is attached to the shaft 15 to extend rearward from the shaft 15 in an obliquely downward direction. If the arm 16 pivots about the shaft 15, the feed rollers 34 vertically moves. Herein, The shaft 15 is attached to the main body 11 at such a position that the feed rollers 34 attached to the other end portion of the arm 16 are located in a rear portion of the tray unit 13.

The arm 16 is biased in one of the pivoting directions thereof by a resilient member (not shown), such as a torsion coil. The arm 16 is biased in such a direction that the feed rollers 34 are biased downward. As described later, the arm 16 slides on an inclined surface 41A of the upper end of a side wall 41 of a main tray 40, or on an inclined surface 54 of a second tray 50. Thereby, when the tray unit 13 is installed into the main body 11, the arm 16 moves downward at a predetermined position. At this time, the feed rollers 34 are pressed onto a rear portion of the sheets placed on the main tray 40 or the second tray 50. When the tray unit 13 is drawn from the main body 11, the arm 16 slides on the inclined surface 41A or 54, and thereby is lifted upward. As a result, the feed rollers 34 are separated from the sheets placed on the main tray 40 or the second tray 50.

A plurality of transmission gears 17 are provided along the longitudinal direction of the arm 16 to transmit the rotation of the shaft 15 to the feed rollers 34. The transmission gears 17 mesh with one another. The transmission gear 17 on the side of the shaft 15 meshes with the shaft 15, and thereby is rotated. The transmission gear 17 on the side of the feed rollers 34 is connected with the feed rollers 34. Therefore, the feed rollers 34 are driven to rotate by the drive unit. In accordance with the rotation of the feed rollers 34, the sheets pressed by the feed rollers 34 is fed to the feed path 31 one by one.

As shown in FIG. 3, the tray unit 13 includes the main tray 40, the second tray 50 disposed above the main tray 40, a third tray 60 disposed above the main tray 40, and a parallel linking mechanism having elongate arms 80. The main tray 40 is configured to hold thereon first sheets. The second tray 50 is configured to hold thereon second sheets to be fed to the feed path and to receive the first sheets discharged from the recording unit 20. The third tray 60 is configured to receive thereon the second sheets discharged from the recording unit 20.

As shown in FIG. 3, the main tray 40 has an upwardly open box shape and includes a bottom 42 for holding thereon the first sheets, a front wall 43, a rear wall 46, and right-left side walls 41. The second tray 50 has a length in the front-rear direction 8 set to approximately half the length in the front-rear direction 8 of the main tray 40. The second tray 50 is supported by the main tray 40, via the parallel linking mechanism, such that the second tray 50 moves between a first position above a rear portion of the bottom 42 of the main tray 40 and a second position above a front portion of the bottom 42. The third tray 60 is disposed between the second tray 50 located in the second position and the front portion of the main tray 40. The third tray 60 is pivotably supported by the main tray 40, as described later. The second tray 50 is configured to move above the main tray 40 in the front-rear direction 8.

As the first sheets and the second sheets, sheets having flexibility, such as recording sheets and plastic sheets, are used. Sheets can be conveyed through the feed path 31 having the arc-shaped cross section shown in FIG. 2. Sheets may be A4- or B5-size sheets, postcards, envelopes, and so forth. The main tray 40 may hold A4- and B5-size sheets, while the second tray 50 may hold small-size sheets, such as postcards and envelopes.

Each of the right-left side walls 41 of the main tray 40 has a pair of front and rear fitting holes (not shown), through which pins 81 are inserted such that the corresponding arms 80 are coupled to the side wall 41. As described later, each of the pins 81 is inserted through a through-hole provided at one end portion in the longitudinal direction of the corresponding arm 80. That is, the main tray 40 supports the above-described one end portion of each of four arms 80 such the arm 80 is pivotable. Alternatively, the arms 80 may be pivotably supported by the main tray 40 using another well-known configuration other than the pins 81. As described later, the other end portion of each of the arms 80 is supported by the second tray 50 using a pin 82 such that the arm 80 is pivotable.

Further, each of the right-left side walls 41 of the main tray 40 has a bearing for receiving a shaft (not shown) provided to the third tray 60. That is, the third tray 60 is pivotably supported by the main tray 40. Alternatively, the third tray 60 may be supported by the main tray 40 using another well-known configuration.

Further, the right side wall 41 of the main tray 40 has the inclined surface 41A for moving the feed rollers 34 in the up-down direction 7 at a predetermined position.

As shown in FIG. 3, the rear wall 46 of the main tray 40 is inclined relative to the bottom 42 of the main tray 40 to guide the first sheets placed on the bottom 42 to the feed path 31. The rear wall 46 has separating projections 47 projecting from the inner surface thereof. The separating projections 47 are formed by, for example, metal pieces. When a sheet is fed to the feed path 31 by the feed rollers 34, the separating projections 47 abut against the leading edge of the sheet, and thereby separate the sheet from an underlying sheet. Further, the rear wall 46 of the main tray 40 has recesses 49A which receive engaging pieces 55 of the second tray 50. Each of the recesses 49A has a hook receiver 49B for receiving a hook of the corresponding engaging piece 55. Peripheral walls of the recesses 49A support a rear end portion of the second tray 50, and position the second tray 50 at a fixed position. The second tray 50 is held in the first position when the hook receivers 49B receive the hooks of the engaging pieces 55, respectively.

The main tray 40 includes a side guide mechanism, at the bottom 42, for positioning the first sheets placed thereon. The second tray 50 also includes a side guide mechanism. The side guide mechanisms of the main tray 40 and the second tray 50 will be described in detail later.

Each of the arms 80 has a bar-like shape, and has a through-hole at each of the opposite end portions thereof in the longitudinal direction such that one of the pins 81 and 82 is inserted through the through-hole. A pair of front and rear arms 80 is attached to the outer surface of each of the right-left side walls 41 of the main tray 40. One end portion of each of the arms 80 is rotatably coupled to the main tray 40 by the pin 81. The other end portion of each of the arms 80 is rotatably coupled to the second tray 50 by the pin 81. Each of the arms 80 is pivotable about the pin 81 while supporting the second tray 50 via the pin 82.

Figure 5A:
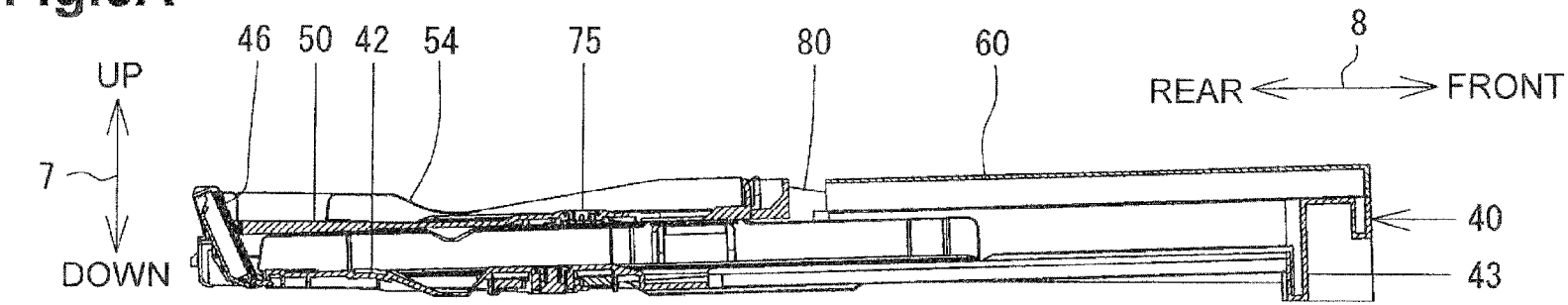
FIG. 5A is a vertical cross-sectional view of the tray unit when the second tray is in the first position.
Figure 5B:
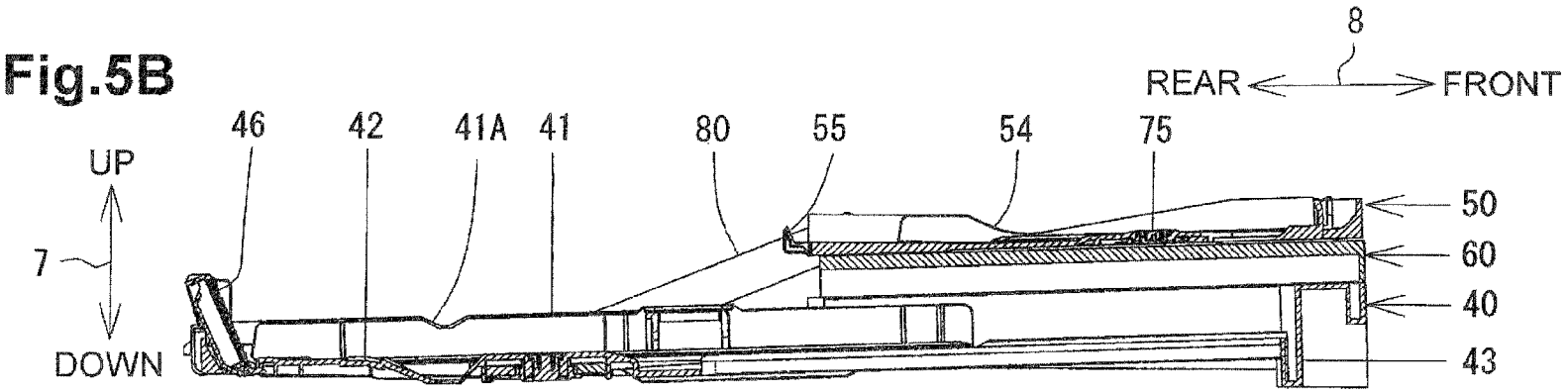
FIG. 5B is a vertical cross-sectional view of the tray unit when the second tray is in the second position.

The third tray 60 has a plate shape. As shown in FIGS. 3 and 5B, the third tray 60 is placed on and supported by the upper end surfaces of the right-left side walls 41 and the front wall 43 of the main tray 40. The shafts (not shown) provided on rear end portions of the right-left end surfaces of the third tray 60 are supported by the shaft bearings (not shown) of the main tray 40. That is, the third tray 60 is pivotably supported at the rear end portion by the main tray 40, and is openable and closable at the front end portion. The user can readily supply the main tray 40 with the first sheets by opening the third tray 60.

The second tray 50 has a rectangular plate shape and has the right-left side surfaces each provided with a pair of front and rear holes (not shown), through which the pins 82 for coupling the arms 80 to the side surface are inserted. That is, the second tray 50 is sandwiched and supported by the pivotable right-left arms 80. The interval between each of the pins 81 and the corresponding pin 82 is set to be substantially the same.

The second tray 50 is disposed above the main tray 40 such that a sheet holding surface 53 of the second tray 50 is substantially parallel to the bottom 42 of the main tray 40. Further, the paired front and rear arms 80 are arranged to be substantially parallel to each other. Therefore, the pairs of front and rear arms 80 function as the parallel linking mechanism and supports the second tray 50 such that the second tray 50 moves in a front-rear direction 8 while maintaining the sheet holding surface 53 substantially parallel to the bottom 42 of the main tray 40. That is, while maintaining the sheet holding surface 53 substantially horizontal, the second tray 50 moves between the first position above the rear portion of the bottom 42 of the main tray 40 and the second position below the discharge roller 36 and above the third tray 60. The position of the second tray 50 is changed relative to the main tray 40 by the user when the tray unit 13 has been drawn from the main body 11. After that, the tray unit 13 is installed into the main body 11 by the user.

Herein, the second tray 50 in the second position is set to be higher than the second tray 50 in the first position such that the second tray 50 in the second position is located closer to the discharge roller 36 than in the first position. Accordingly, the sheet discharged from the discharge roller 36 is properly stacked on the second tray 50 without being folded or bent.

The second tray 50 includes, at the rear end surface thereof, the engaging pieces 55 to be received by the recesses 49A formed in the rear wall 46 of the main tray 40. Each of the engaging pieces 55 has the hook (not shown) engaging with the hook receivers 49B of the recesses 49A. With the engaging pieces 55 fitted in the recesses 49A, the second tray 50 is positioned in the first position and the rear end portion thereof is supported. Further, while the hooks of the engaging pieces 55 are engaged with the hook receivers 49B, the second tray 50 is held in the first position until the user moves the second tray 50. Further, the inclined surface 54 is formed in the upper surface of the second tray 50. If the tray unit 13 is installed into the main body 11 with the second tray 50 located in the first position, the arm 16 slides on the inclined surface 54, and thereby the feed rollers 34 move downward at a predetermined position. If the tray unit 13 is drawn from the main body 11 with the second tray 50 located in the first position, the arm 16 slides on the inclined surface 54, and thereby the feed rollers 34 are lifted upward and separated from the second sheets.

The second tray 50 includes the side guide mechanism for positioning the second sheets in the right-left direction 9. As shown in FIG. 3, the side guide mechanism includes positioning members 70, rack gears 74, and a pinion gear 75. The side guide mechanism is disposed on the sheet holding surface 53 which extends from a center portion toward both side portions of the second tray 50 in the right-left direction 9.

Each of the positioning members 70 includes a plate 71 placed on the sheet holding surface 53 and a side plate 73 standing upward from one end in the right-left direction 9 of the plate 71. The right-left positioning members 70 are opposed to each other in the right-left direction 9. Each of the positioning members 70 is coupled to the corresponding rack gear 74 which extends from the positioning member 70 to the center of the second tray 50 in the right-left direction 9. Each of the rack gears 74 is supported by the second tray 50 to be slidable in the right-left direction 9. Respective central end portions of the right-left rack gears 74 are opposed to each other in the front-rear direction 8. The pinion gear 75 is rotatably attached to the second tray 50 and is sandwiched by the central end portions of the rack gears 74.

If one of the positioning members 70 is moved in one direction parallel to the right-left direction 9, the other positioning member 70 moves in the other direction parallel to the right-left direction 9 via the rack gears 74 and the pinion gear 75. That is, the right-left positioning members 70 move close to or away from each other. The user places the second sheets between the right-left positioning members 70, and thereafter slides the positioning members 70 such that the positioning members 70 contact the right-left edges of the second sheets. The second sheets are positioned in center alignment such that the center thereof in the right-left direction 9 is aligned with the center of the second tray 50.

The side guide mechanism of the main tray 40 is configured similar to the side guide mechanism of the second tray 50. The first sheets placed on the main tray 40 are positioned in center alignment. Alternatively, a side guide mechanism for positioning the first sheets in edge alignment may be employed such that edges in the right-left direction 9 of the first sheets are aligned with an edge in the right-left direction 9 of the main tray 40 or the second tray 50.

Further, each of the main tray 40 and the third tray 60 includes a positioning portion (not shown), e.g., a receiving portion, configured to receive the second tray 50. For example, each of the receiving portions of the main tray 40 and the third tray 60 may be formed as a groove or a recess in which a rib projecting from the lower surface of the second tray 50 is fitted.

When the second tray 50 is in the first position, the feed rollers 34 feed the second sheet from the second tray 50, and the third tray 60 receives the second sheet discharged by the discharging roller 36. At this time, the second tray covers a rear side of the main tray 40, and the third tray covers a front side of the main tray 40. That is, the second tray covers a downstream side of the main tray 40 in a sheet feeding direction parallel to the front-rear direction 8, and the third tray covers an upstream side of the main tray 40 in the sheet feeding direction 8.

When the second tray 50 is in the second position, the feed rollers 34 feed the first sheet from the main tray 40, and the second tray 50 located above the third tray 60 receives the first sheet discharged by the discharging roller 36. One of vertically opposite surfaces of the second tray 50, on which the sheet holding surface 53 is formed, receives the discharged first sheet. When the second tray 50 is in the second position, the second tray 50, the third tray 60, and the main tray 40 overlap one another vertically, in this order from the top.

when the second tray 50 moves between the first position close to the rear wall 46 of the main tray 40 and the second position away from the rear wall 46, each of the arms 80 of the parallel linking mechanism pivots between a first pivot position and the second pivot position, respectively. When the second tray 50 moves from the first position to the second position, the third tray 60 disposed above the main tray 40 receives a lower surface of the second tray 50 and thereby stops each of the arms 80 from pivoting beyond the second pivot position in a direction away from the first pivot position.

Operations of the main tray will be described. For instance, the user draws the tray unit 13 from the main body 11, places the first sheets on the main tray 40 by pivoting the third tray 60, moves the second tray 50 to the second position, and then installs the tray unit 13 into the main body 11. At this time, the feed rollers 34 press-contact the first sheets placed on the main tray 40, and feed the first sheet to the feed path 31 one by one. Consequently, an image is recorded on the first sheet. The second tray 50 in the second position is located below the discharge roller 36. Therefore, the first sheet discharged from the discharge roller 36 is stacked on the second tray 50.

In another instance, the user draws the tray unit 13 from the main body 11, places the second sheets on the second tray 50, moves the second tray 50 from the second position to the first position, and installs the tray unit 13 into the main body 11. At this time, the feed rollers 34 press-contact the second sheets placed on the second tray 50, and feed the second sheets to the feed path 31 one by one. Consequently, an image is recorded on the second sheet. Because the second tray 50 is located in the first position, the second sheet having the image recorded thereon and discharged by the discharge roller 36 is stacked on the third tray 60 located below the discharge roller 36.

In the above-described embodiment, the second tray 50 for holding the second sheets subjected to image recording is also used as a discharge tray for receiving the first sheets having an image recorded thereon. When the second tray 50 is in the second position and is used as the discharge tray, the second tray 50 is located higher and closer to the discharge roller 36 than when in the first position. Thus, the first sheet discharged by the discharge roller 36 is properly received by the second tray 50.

Further, the second tray 50 is configured to move while maintaining the sheet holding surface 53 substantially parallel to the bottom 42 of the main tray 40, i.e., while maintaining the sheet holding surface 53 substantially horizontal. Thus, even when the second tray 50 is changed in position by the user, the second sheets placed on the sheet holding surface 53 of the second tray 50 are prevented from dropping from the second tray 50. Further, the periphery of the second sheets placed on the sheet holding surface 53 is surrounded by the side plates 73 of the positioning members 70 and the engaging pieces 55. This prevents the dropping of the second sheets. The second tray 50 may not necessarily be maintained exactly horizontal. It suffices if the second tray 50 is maintained at such an angle that prevents the second sheets on the second tray 50 from dropping when the second tray 50 is changed in position.

Although, in the above-described embodiment, the tray unit 13 includes the main tray 40, the second tray 50, and the third tray 60, the tray unit 13 may be eliminated from the tray unit 13. In this case, the main tray 40 may have a supporting portion, e.g., a rib, for supporting the second tray 50 in the second position. When the second tray 50 is in the first position, the second sheets discharged by the discharge roller 36 may be stacked on the front portion of the main tray 40.

Alternatively, instead of the above-described supporting portion, a stopper or stoppers for stopping the pivoting of the arms 80 may be provided in the main tray when the third tray 60 is eliminated from the tray unit 13. Projections may be formed, as stoppers, to project from the side walls 41 of the main tray 40 and may stop the pivoting of the arms 80 such that the second tray 50 is positioned in the second position.

In the above-described embodiment, the parallel linking mechanism is used to move the second tray 50 between the first and second positions. However, the second tray 50 may be changed in position by attaching and detaching the second tray 50 to and from the first and second positions manually without using any linking mechanism, or the second tray 50 may be changed in position using another moving mechanism, e.g. a pivoting mechanism.

As another configuration for moving the second tray 50 while maintaining it in a substantially horizontal state, the inner surfaces of the right-left side walls 41 of the main tray 40 may be provided with rail grooves extending parallel to each other, and the second tray 50 may have right-left fitting portions that fit in the rail grooves respectively such that the right-left side walls 41 of the main tray 40 sandwich and hold the second tray 50.

Although, in the above-described embodiment, the main tray 40 and the second tray 50 are coupled by a pair of right arms 80 provided on the right side of the tray unit 13 and a pair of left arms 80 provided on the left side of the tray unit 13, the main tray 40 and the second tray 50 may be coupled by only either a pair of right arms 80 or a pair of left arms 80.

In the above-described embodiment, the sheet holding surface 53 of the second tray 50 in the first position 50 serves as the sheet receiving surface when the second tray 50 is in the second position. However, the second tray 50 may pivot about an end thereof such that the sheet holding surface 53 faces upward when the second tray 50 is in the first position and faces downward when the second tray 50 is in the second position. That is, a surface of the second tray which is opposite to the sheet holding surface 53 may receive discharged first sheets when the second tray 50 is in the second position.

In the above-described embodiment, the second tray 50, the third tray 60, and the main tray 40 overlap one another vertically from the top in this order when the second tray 50 is in the second position. However, the third tray 60 may be positioned at the top of the tray unit 13, regardless of where the second tray 50 is located in the front-rear direction 8, and may receive both first and second sheets discharged by the discharge roller 36. In this case, the third tray 60 may be configured to be supported by the main tray 40 and to extend over the second tray 50 located in the second position away from the rear wall 46.

While the invention has been described in connection with embodiments of the invention, it will be understood by those skilled in the art that variations and modifications of the embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being defined by the following claims.

What is claimed is:

1. An image recording device comprising:

a tray unit configured to hold thereon a first sheet and a second sheet;

a sheet feeder disposed above the tray unit and configured to selectively feed the first sheet and the second sheet from the tray unit in a first direction;

a recording unit disposed above the sheet feeder and configured to record an image on the sheet fed by the sheet feeder; and a discharging unit configured to discharge the sheet after the recording unit records the image on the sheet, wherein the tray unit comprises:

a first tray comprising a first holding surface for holding thereon the first sheet;

a second tray disposed above the first tray and comprising a second holding surface for holding thereon the second sheet, wherein the second tray is configured to move relative to the first tray between a first position and a second position which is upstream in the first direction from the first position; and a third tray disposed above the first tray, wherein when the second tray is in the first position, the sheet feeder is configured to feed the second sheet from the second tray, and the third tray is configured to receive the second sheet discharged by the discharging unit, wherein when the second tray is in the second position, the sheet feeder is configured to feed the first sheet from the first tray, and the first tray, the second tray, and the third tray overlap one another vertically, wherein the second tray is configured to move independently of the third tray, and wherein when the second tray is in the second position, the third tray is located between the first tray and the second tray.

2. The image recording device according to claim 1, wherein the second tray located in the second position is higher than the second tray located in the first position.

3. The image recording device according to claim 1, wherein when the second tray is in the second position, the second tray is located above the third tray and receives the first sheet discharged by the discharging unit.

4. The image recording device according to claim 3, wherein the second tray comprises a receiving surface for receiving the first sheet, and the receiving surface and the second holding surface are formed on a same one of vertically opposite surfaces of the second tray.

5. The image recording device according to claim 1, wherein when the second tray is in the first position, the second tray covers a downstream side of the first tray in the first direction, and the third tray covers an upstream side of the first tray in the first direction.

6. The image recording device according to claim 1, wherein the tray unit further comprising a linking unit configured to link the first tray to the second tray and to pivot about a pivot axis extending in a second direction perpendicular to the first direction and parallel to the first holding surface of the first tray, and wherein the linking unit pivots to selectively move the second tray between the first position and the second position.

7. The image recording device according to claim 6, wherein the linking unit comprises a first arm member having a first end portion rotatably coupled to the first tray and a second end portion rotatably coupled to the second tray, and when the first arm member pivots about the pivot axis which passes through the first end portion, the second tray selectively moves between the first position and the second position.

8. The image recording device according to claim 7, wherein the linking unit further comprises a second arm member spaced apart from the first arm member in the first direction and having a first end portion rotatably coupled to the first tray and a second end portion rotatably coupled to the second tray.

9. The image recording device according to claim 8, wherein the first end portion of each of the first arm member and the second arm member is coupled to one of opposite ends of the first tray in the second direction, and the second end portion of each of the first arm member and the second end member is coupled to one of opposite ends of the second tray in the second direction.

10. The image recording device according to claim 8, wherein when the first arm member and the second arm member pivot, the second tray moves between the first position and the second position while the second holding surface of the second tray is maintained substantially parallel to the first holding surface of the first tray.

11. The image recording device according to claim 1, wherein the second tray comprises an engaging portion and the first tray comprises an engaged portion, and the engaging portion of the second tray engages the engaged portion of the first tray when the second tray is in the first position.

12. An image recording device comprising:

a tray unit comprising:

a first tray comprising a first holding surface for holding thereon a first sheet; and a second tray disposed above the first tray and comprising a second holding surface for holding thereon a second sheet;

a sheet feeder disposed above the tray unit and configured to selectively feed the first sheet and the second sheet from the tray unit in a first direction;

a recording unit disposed above the sheet feeder and configured to record an image on the sheet fed by the sheet feeder;

a discharging unit configured to discharge the sheet after the recording unit records the image on the sheet;

a linking unit configured to link the first tray to the second tray and to pivot about a pivot axis extending in a second direction perpendicular to the first direction and parallel to the first holding surface of the first tray; and a stopper configured to stop the linking unit from pivoting beyond a second pivot position in a direction away from a first pivot position, wherein when the linking unit is in the first pivot position, the second tray is located in a first position, and the sheet feeder is configured to feed the second sheet from the second tray, wherein when the linking unit is stopped by the stopper in the second pivot position, the second tray is located in a second position which is higher than the first position and upstream from the first position in the first direction, and the second tray is configured to receive the first sheet discharged by the discharging unit, and wherein the linking unit comprises a first arm member having a first end portion rotatably coupled to the first tray and a second end portion rotatably coupled to the second tray, and when the first arm member pivots about the pivot axis which passes through the first end portion, the second tray selectively moves between the first position and the second position.

13. The image recording device according to claim 12, wherein the tray unit further comprising a third tray disposed above the first tray and configured to receive a lower surface of the second tray located in the second position and to stop, as the stopper, the linking unit from pivoting beyond the second pivot position.

14. The image recording device according to claim 13, wherein when the second tray is in the first position, the second tray covers a downstream side of the first tray in the first direction, and the third tray covers an upstream side of the first tray in the first direction.

15. The image recording device according to claim 12, wherein the linking unit further comprises a second arm member spaced apart from the first arm member in the first direction and having a first end portion rotatably coupled to the first tray and a second end portion rotatably coupled to the second tray.

16. The image recording device according to claim 15, wherein the first end portion of each of the first arm member and the second arm member is coupled to one of opposite ends of the first tray in the second direction, and the second end portion of each of the first arm member and the second end member is coupled to one of opposite ends of the second tray in the second direction.

17. The image recording device according to claim 12, wherein when the linking unit pivots between the first pivot position and the second pivot position, the second tray moves between the first position and the second position while the second holding surface of the second tray is maintained substantially parallel to the first holding surface of the first tray.

18. The image recording device according to claim 12, wherein the second tray comprises an engaging portion and the first tray comprises an engaged portion, and the engaging portion of the second tray engages the engaged portion of the first tray when the second tray is in the first position.

* * * * *